US005775311A

United States Patent [19]

Kato et al.

[11] Patent Number: 5,775,311

[45] Date of Patent: Jul. 7, 1998

[54] FEEDBACK ENGINE CONTROL

[75] Inventors: Masahiko Kato; Hitoshi Motose; Kimihiro Nonaka, all of Hamamatsu, Japan

[73] Assignee: Sanshin Kogyo Kabushiki Kaisha, Hamamatsu, Japan

[21] Appl. No.: 756,956

[22] Filed: Dec. 2, 1996

[30] Foreign Application Priority Data

Nov. 30, 1995 [JP] Japan ..... 7-312716

[51] Int. Cl.[6] ..... F02D 41/00

[52] U.S. Cl. ..... 123/681; 123/688

[58] Field of Search ..... 123/681, 679, 123/682, 683, 688

[56] References Cited

U.S. PATENT DOCUMENTS 4,320,730 3/1982 Takada et al. ..... 123/440

4,825,837 5/1989 Nakagawa ..... 123/489

4,913,120 4/1990 Fujimoto et al. ..... 123/489

5,347,974 9/1994 Togai et al. ..... 123/682

*Primary Examiner*—Raymond A. Nelli

*Assistant Examiner*—Hieu T. Vo

*Attorney, Agent, or Firm*—Knobbe, Martens, Olson & Bear LLP

[57] ABSTRACT

An engine feedback control system that includes an arrangement for setting lower tolerance limits on the rich and lean side in response to certain engine running characteristics so as to avoid unstable running as might occur under abnormal conditions when wider limits are set as with prior art type constructions. In addition, the increasing limit of fuel supply is set different from the decreasing limits so as to maintain the engine operation within the stable running area regardless of whether the conditions are normal or abnormal.

16 Claims, 10 Drawing Sheets

⊕ Limits %

Engine Load ↑

| | | | | |
|---|---|---|---|---|
| 20 | 20 | 7 | 7 | 7 |
| 20 | 20 | 20 | 20 | 20 |
| 20 | 20 | 10 | 10 | 20 |
| 20 | 20 | 10 | 10 | 20 |
| 10 | 12 | 20 | 20 | 20 |

Engine Speed →

*Figure 7*

⊖ Limits %

Engine Load ↑

| | | | | |
|---|---|---|---|---|
| 20 | 20 | 5 | 5 | 5 |
| 7 | 7 | 20 | 20 | 20 |
| 7 | 7 | 7 | 7 | 7 |
| 20 | 20 | 7 | 7 | 7 |
| 10 | 12 | 20 | 20 | 20 |

Engine Speed →

*Figure 8*

FEEDBACK ENGINE CONTROL

BACKGROUND OF THE INVENTION

This invention relates to an engine and control system for an engine and more particularly to an improved feedback control system and abnormality operation phase of such a system.

Engine feedback control systems are very effective in ensuring that engine is controlled so as to maintain the desired air fuel ratio under a wide variety of running conditions. Generally, the way the systems operate is that the system sets a predetermined amount of fuel supply and then senses the actual air fuel ratio consumed in the engine. This is generally done through the use of a sensor such as an oxygen ($O_2$) sensor that will sense the actual air fuel ratio by measuring the amount of residual oxygen in the exhaust gas. The system makes finite adjustments in order to maintain the air fuel ratio at the desired amount.

FIG. 1 is an illustration of a prior art fuel feedback control system utilized in conjunction with a fuel injected engine. The upper portion of this curve shows the output of the oxygen sensor while the lower curve shows the adjustments that are made in fuel injection amount in response to the output signal from the sensor. As may be seen in these curves, when the fuel injection sensor outputs a signal that deviates from the norm, an adjustment is made in the amount of fuel injected. Generally, the adjustment begins by making a first adjustment of a fixed amount and then subsequent adjustments in somewhat smaller increments and these continue until the sensor output returns to the desired range.

With these type systems, however, the maximum amount of fuel adjustment permitted during a given control cycle is generally limited. This is done to avoid continued and possibly unnecessary adjustments in the event of an abnormality in operation of the feedback system. For if the sensor fails or becomes fouled the adjustments could be made well beyond the amount necessary or even desirable. These limitation in adjustment are applied both when going toward the rich and the lean sides.

As a result, if there is an error in the system, as seen by the broken line view on the rich "a" side of FIG. 1, the injection amount will continue to be adjusted toward the lean side and this will cause the mixture to become unduly lean and result in poor engine running. The systems generally also include an arrangement wherein if the sensor value does not return to the normal value after a predetermined amount of adjustment is made the adjustment is held fixed and then reverts to a map-type control. This is depicted in the upper curve of FIG. 1 by the "predetermined time" line when the mixture strength is held constant and then drops to the value set by the map control.

The same procedure operates if the mixture goes lean as shown by the "b" side dot dash line in these two curves. The same type of routine is followed. That is, a maximum adjustment is permitted, generally in the same magnitude as the lean adjustment, and then it is held for a fixed time. If the sensor outputs does not come back to the desired ratio, the program reverts to an open control.

As a result of this type of prior art system, the engine can run substantially outside of the desired range during the abnormal running and map control positions.

It is, therefore, a principal object of this invention to provide an improved feedback control system for an engine.

It is a still further object of this invention to provide a feedback control system and method having an improved failure operational mode wherein the engine will not operate as far outside of the desired range even in the event of failure in the feedback control.

As has also been noted, the maximum amount of adjustment permitted generally is the same on both the rich or lean sides. However, this is also not desirable because in some engine running conditions it may be desirable to permit greater latitude of either rich or lean adjustments then the other.

It is, therefore, a still further object of this invention to provide an improved abnormal engine control arrangement for a feedback control system for an engine wherein the limits of adjustment before reverting to a map control are varied on the rich side differently from on the lean side.

As has also been noted, the adjustment or maximum permissible adjustment during feedback control has been limited. This limitation has been the same regardless of the engine running condition. As a result, under some engine running conditions and when there is an abnormal situation, the mixture deviation may be greater from the desired ratio then under others. In addition, it may be desirable to permit a wider latitude of permissible adjustments under some conditions then others.

It is, therefore, a still further objection of this invention to provide an improved engine feedback control system that accommodates abnormal situations and wherein the operational limit of adjustment before reverting to an open map condition vary depending upon the actual running conditions of the engine.

SUMMARY OF THE INVENTION

This invention is adapted to be embodied in an engine feedback control system and method. The engine includes a combustion chamber, a fuel air charging system for delivering fuel and air to the combustion chamber and an exhaust system for discharging a burnt charge from the combustion chamber. A control system is incorporated that embodies a device for sensing the engine running characteristics. In addition, an engine combustion condition sensor is provided for sensing the air fuel ratio of the combustion products in the combustion chamber.

In accordance with a method for practicing the invention, the maximum adjustments in fuel air ratio permitted during feedback control both in the rich and lean sides is set so as to be different for different engine running conditions.

In accordance with an apparatus for performing the invention, the control system sets maximum limits of air fuel ratio adjustment in response to various engine running conditions so that the limits on the rich and lean side are varied in response to sensed engine running conditions.

In accordance with a further feature of the invention, both the method and apparatus function so as to set a different limit on the rich side than on the lean side under at least some running conditions.

BRIEF DESCRIPTION OF THE DRAWINGS

FIG. 7 is a graphical view showing a control map limits utilized during the increase phase of fuel adjustment.

FIG. 8 is a typical lookup map of the type used for the limits set during the fuel reduction phase.

DETAILED DESCRIPTION OF THE PREFERRED EMBODIMENTS OF THE INVENTION

Figure 2:
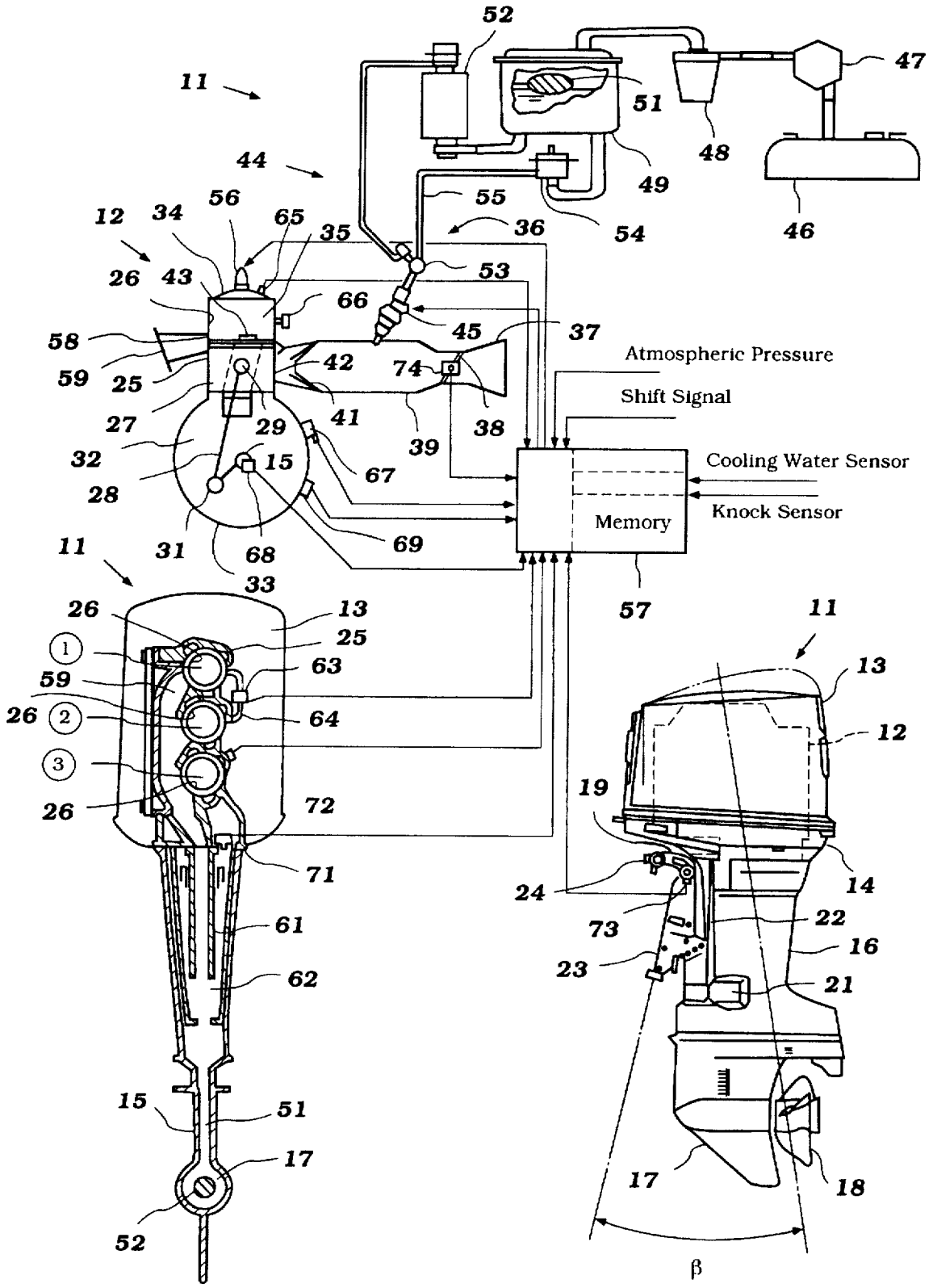
FIG. 2 is a composite view consisting of, at the bottom, right hand side, a partial side elevational view of an outboard motor constructed and operated in accordance with an embodiment of the invention. The lower, left hand view of this figure is a cross sectional view taken generally along a vertical line in the lower right hand view. The remaining, upper view is a partially schematic cross sectional view taken through a single cylinder of the engine showing the components associated with the control system.

Referring now in detail to the drawings and initially to FIG. 2, an outboard motor constructed in accordance with an embodiment of the invention is identified generally by the reference numeral 11. The invention is described in conjunction with an outboard motor because the invention deals with an internal combustion engine and the control system therefor. Therefore, an outboard motor is a typical application in which an engine constructed and operated in accordance with the invention may be utilized.

The outboard motor 11 is comprised of a power head that consists of a powering internal combustion engine, indicated generally by the reference numeral 12 and a surrounding protective cowling comprised of a main cowling portion 13 that is detachably connected to a tray portion 14.

As is typical with outboard motor practice, the engine 12 is supported within the power head so that its output shaft, a crankshaft indicated by the reference numeral 15 in the upper view of this figure, rotates about a vertically-extending axis. This output shaft or crankshaft 15 is rotatably coupled to a drive shaft (not shown) that depends into and is journaled within a drive shaft housing 16. The tray 14 encircles the upper portion of the drive shaft housing 16.

The drive shaft continues on into a lower unit 17 where it can selectively be coupled to a propeller 18 for driving the propeller 18 in selected forward or reverse direction so as to so propel an associated load, namely a watercraft. A conventional forward, reverse bevel gear transmission is provided for this purpose.

A steering shaft (not shown), having a tiller 19 affixed to its upper end, is affixed in a suitable manner, by means which include a lower bracket assembly 21, to the drive shaft housing 16. This steering shaft is journaled within a swivel bracket 22 for steering of the outboard motor 11 about a vertically-extending axis defined by the steering shaft.

The swivel bracket 22 is, in turn, connected to a clamping bracket 23 by means of a trim pin 24. This pivotal connection permits tilt and trim motion of the outboard motor 11 relative to the associated transom of the powered water craft. The trim adjustment through the angle β permits adjustment of the angle of the attack of the propeller 18 to obtain optimum propulsion efficiency. In addition, beyond the range defined by the angle β, the outboard motor 11 may be tilted up to and out of the water position for trailering and other purposes, as is well known in this art.

The construction of the outboard motor 11 as thus far described may be considered to be conventional and for that reason, further details of this construction are not illustrated nor are they believed necessary to permit those skilled in the art to practice the invention.

Continuing to refer to FIG. 2 but now referring primarily the lower left hand portion of this figure and the upper portion, the engine 12 is, in the illustrated embodiment, of the three-cylinder in-line type. To this end, the engine 12 is provided with a cylinder block 25 in which three horizontally extending, vertically aligned, parallel cylinder bores 26 are formed. Although the invention is described in conjunction with a three-cylinder in-line engine, it will be readily apparent to those skilled in the art how the invention may be utilized with engines having various cylinder numbers and cylinder configurations. In addition, the invention may also be employed with four stroke engines.

Pistons shown schematically at 27 in FIG. 2 are connected to connecting rods 28 by means of piston pins 29 (see primarily the upper view of FIG. 2). The lower or big ends of the connecting rods 28 are journaled on respective throws 31 of the output shaft or crankshaft 15, as is well known in this art.

The crankshaft 15 is rotatably journaled within a crankcase chamber 32 formed at the lower ends of the cylinder bores 26. The crankcase chambers 32 are formed by the skirt of the cylinder block 25 and a crankcase member 33 that is affixed to the cylinder block 25 in any well known manner. As has been noted, the engine 12 operates on a two-cycle crankcase compression principal. As is typical with such engines, the crankcase chambers 32 associated with each of the cylinder bores 26 are sealed relative to each other in any suitable manner.

The ends of the cylinder bores 26 opposite the crankcase chambers 32 are closed by means of a cylinder head assembly 34 that is affixed to the cylinder block 25 in any known manner. The cylinder head assembly 34 has recesses which cooperate with the cylinder bores 26 and the heads of the pistons 27 to form combustion chambers, indicated generally by the reference numeral 35. These combustion chambers 35 have a volume which varies cyclically during the reciprocation of the pistons 27 as is well known in this art.

An intake charge is delivered to the crankcase chambers 32 for compression therein by means of a charge forming and induction system, indicated generally by the reference numeral 36. The charge forming and induction system 36 includes an air inlet device 37 that is disposed within the protective cowling of the power head and which draws air therefrom. This air is admitted to the interior of the protective cowling by one or more air inlets formed primarily in the main cowling member 13.

A throttle valve 38 is positioned in the induction passage or intake manifold 39 that connects the air inlet device 37 to respective intake ports 41 formed in the cylinder block 25 and which communicate with the crankcase chambers 32 in a well known manner.

Reed type check valves 42 are provided in each of the intake ports 41 so as to permit a charge to flow into the crankcase chambers 32 when the pistons 27 are moving upwardly in the cylinder bores 26. On the other hand, when the pistons 27 move downwardly these valves 42 close and the charge is compressed in the crankcase chambers 32. The compressed charge is transferred to the combustion chambers 35 through one or more scavenge passages 43.

Fuel is supplied to the air charge admitted as thus far described by a charge forming system, indicated generally by the reference numeral 44. This charge forming system 44 includes one or more fuel injectors 45 that spray into each of the intake passages 39. The fuel injectors 45 are of the electrically operated type having electrically actuated solenoid injector valves (not shown) that control the admission or spraying of fuel into the intake passages 39 upstream of the check valves 42.

Fuel is supplied to the fuel injectors from a remotely positioned fuel tank 46. The fuel tank 46 is, most normally, positioned within the hull of the associated watercraft as is well known in this art. The fuel is drawn through a supply conduit by a pumping system including an engine driven low pressure pump 47 and a filter 48. The pumped fuel is passed from the filter 48 to a vapor separator 49 through a valve operated by a float. An electrically driven high pressure pump 52 increases the fuel pressure and discharges into a main fuel rail 53. The high pressure pump 52 may preferably be positioned in the vapor separator 49 but is shown externally for ease of illustration. The fuel rail 53 supplies fuel to each of the fuel injectors 45 in a known manner.

A pressure control valve 54 is provided in or adjacent the fuel rail 53 and controls the maximum pressure in the fuel rail 53 by dumping excess fuel back to the fuel tank 46 or some other place in the system upstream of the fuel rail 53 through a return conduit 55. The fuel that is mixed with the air in the induction and charge forming system 36 as thus far described will be mixed and delivered to the combustion chambers 35 through the same path already described.

Spark plugs 56 are mounted in the cylinder head 34 and have their gaps extending into the respective combustion chambers 35. These spark plugs 56 are fired by ignition coils that are actuated by an ignition circuit that is controlled by a control means which includes an electronic control unit or ECU 57 which will be discussed in detail later.

When the spark plugs 56 fire, the charge in the combustion chambers 35 will ignite, burn and expand. This expanding charge drives the pistons 27 downwardly to drive the crankshaft 15 in a well known manner. The exhaust gases are then discharged through one or more exhaust ports 58 which open through the sides of the cylinder block bores 26 and communicate with an exhaust manifold 59 as shown schematically in the upper view of FIG. 2 and in more detail in the lower left side view of this figure.

Referring now primarily to the lower left hand side view of FIG. 2, the exhaust manifold 59 terminates in a downwardly facing exhaust discharge passage that is formed in an exhaust guide plate upon which the engine 12 is mounted. This exhaust guide plate delivers gases to an exhaust pipe 61 that depends into the drive shaft housing 16.

The drive shaft housing 16 defines an expansion chamber 62 in which the exhaust pipe 61 terminates. From the expansion chamber 62, the exhaust gases are discharged to the atmosphere in any suitable manner such as by means of a underwater exhaust gas discharge which discharges through the hub of the propeller 18 in a manner well known in this art. At lower speeds when the propeller 18 is more deeply submerged, the exhaust gases may exit through and above the water atmospheric exhaust gas discharge (not shown) as also is well known in this art.

In addition to controlling the timing of the firing of the spark plugs 56, the ECU 57 also controls the timing and duration of fuel injection of the fuel injector 45 and may control other engine functions. For this purpose, there are provided a number of engine and ambient condition sensors. In addition, there is provided a feedback control system through which the ECU 57 controls the fuel air ratio in response to the measurement of the actual fuel air ratio by a combustion condition sensor such as an oxygen ($O_2$) sensor 63 which is positioned in a passageway 64 that interconnects two of the cylinder bores 26 at a point adjacent the point where the exhaust ports 58 are located.

In addition to the $O_2$ sensor 63, other sensors of engine and ambient conditions are provided. These include an in-cylinder pressure sensor 65 and knock sensor 66 that are mounted in the cylinder head 34 and cylinder block 25, respectively. The outputs from these sensors are transmitted to the ECU 57.

Air flow to the engine may be measured in any of a variety of fashions and this may be done by sensing the pressure in the crankcase chamber 32 by means of a pressure sensor 67. As is known, actual intake air flow can be accurately measured by the measuring the pressure in the crankcase chamber 32 at a specific crank angle. A crank angle position sensor 68 is, therefore, associated with the crankshaft 15 so as to output a signal to the ECU 57 that can be utilized to calculate intake air flow and, accordingly, the necessary fuel amount so as to maintain the desired fuel air ratio. The crank angle sensor 68 may be also used as a means for measuring engine speed, as is well known in this art.

Intake air temperature is measured by a crankcase temperature sensor 69 which is also positioned in the crankcase 33 and senses the temperature in the crankcase chambers 32.

Exhaust gas back pressure is measured by a back pressure sensor 71 that is mounted in a position to sense the pressure in the expansion chamber 62 within the drive shaft housing 16.

Engine temperature is sensed by an engine temperature sensor 72 that is mounted in the cylinder block 25 and which extends into its cooling jacket. In this regard, it should be noted that the engine 12 is, as is typical with outboard motor practice, cooled by drawing water from the body of the water in which the outboard motor 11 operates. This water is circulated through the engine 12 and specifically its cooling jackets and then is returned to the body of water in any suitable return fashion.

The temperature of the intake water drawn into the engine cooling jacket is also sensed by a temperature sensor which is not illustrated but which is indicated by an arrow and legend in FIG. 2. In addition other ambient conditions such as atmospheric air pressure are transmitted to the ECU 57 by appropriate sensors and as indicated by the arrows in FIG. 2.

A trim angle sensor 73 is provided adjacent the trim pin 24 so as to provide a signal indicative of the angle β.

A throttle angle position sensor 74 is also provided and outputs a signal indicative of the position of the throttle valve 38 to the ECU 57.

The basic control strategy for operation of the engine 12 can be of any desired type. That is, the ECU 57 calculates from various engine parameters and from look-up data contained within an internal memory the appropriate timing for the beginning of fuel injection from the injector 45, the duration of injection (i.e., the amount of fuel to be injected each time) and the appropriate timing interval for firing the spark plugs 56.

Figure 3:
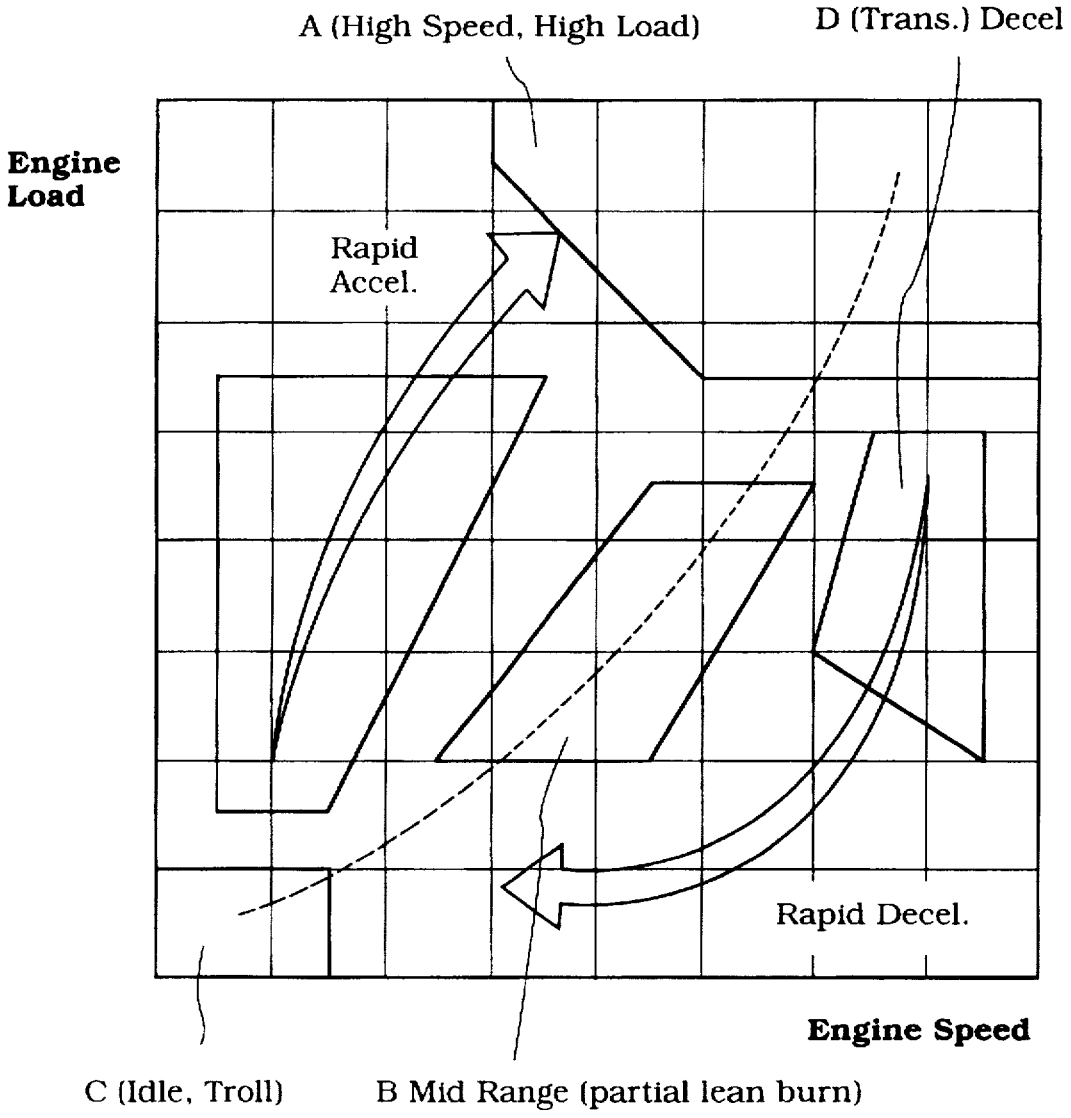
FIG. 3 is a graphical view showing the various control ranges in accordance with the preferred embodiment of the invention.

This feedback control system basically sets a basic fuel injection amount from the engine parameters as memorized in memory that contains a map responsive to certain engine conditions. This map or basic control signal may vary in response to specific engine running characteristics. That is, under some conditions, the mixture may be set to be richer or leaner than under others. This type of control map strategy for both the map and feedback control may be understood by reference to FIG. 3 which shows the various control ranges. These ranges include a first range A which is the high speed, high load range as may be seen in FIG. 3 at the upper right-hand side of the mapped area shown in FIG. 3.

Another control range, indicated at B, is midrange performance. In accordance with the desired control strategy of the invention this is a partial lean burn setting. In other words, the air fuel ratio is somewhat on the low side of stoichiometric.

There is a further zone, indicated at C, which is a low speed, low load range and one which is particularly prevalent and frequently used in conjunction with outboard motor such as the outboard motor 11. This is the idle or trolling range. As well known in the marine art, the engine speed at trolling is lower than idle speed because the engine is actually driving the watercraft under this condition.

There are also two ranges of transitional zones indicated at D. The first of these is the rapid acceleration phase and is at the lower speed low end side of the map while the other is the rapid deceleration phase which is at the higher speed higher load side of the map. The remainder of the map is a further control zone which will be described later.

Figure 5:
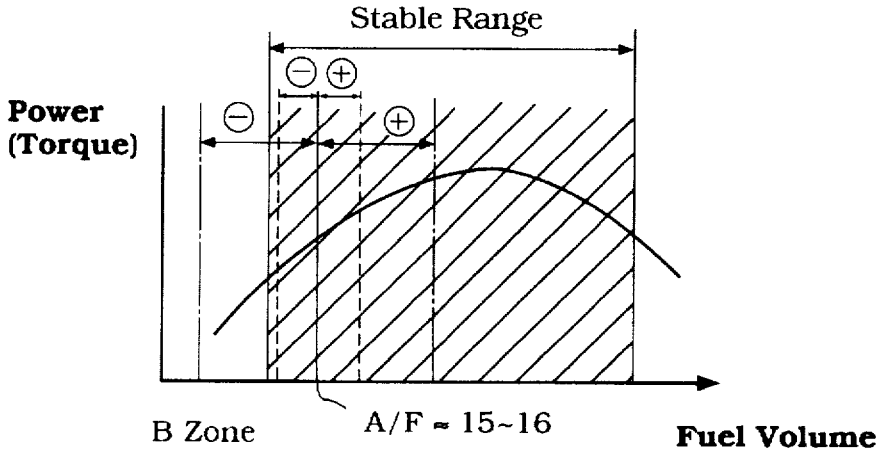
FIG. 5 is a graphical view, in part similar to FIG. 4, but shows the corresponding ranges of control in accordance with the phase of engine operation indicated at the midrange partial lean set region (Region B).
Figure 6:
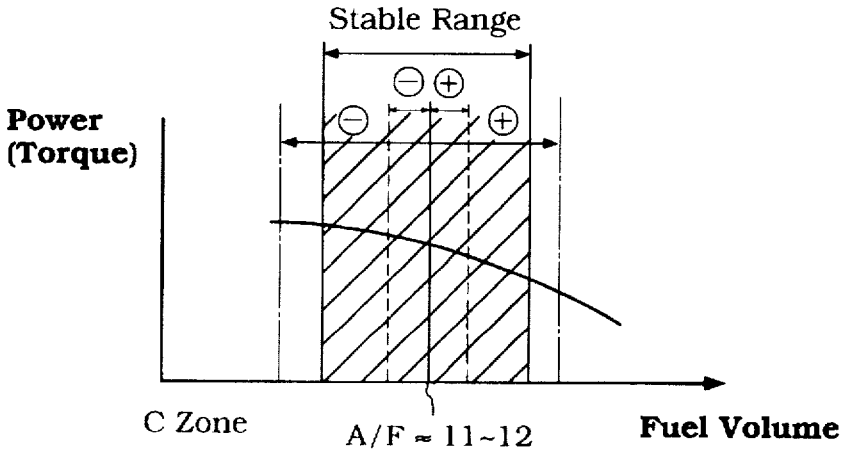
FIG. 6 is a graphical view, in part similar to FIGS. 4 and 5, and shows the same features in the very low speed and idle control zone (Region C).

As has been noted, the conventional systems operate so as to permit a maximum amount of total increase in fuel supply when the oxygen sensor 63 indicates that there is a lean condition and an equivalent maximum reduction in fuel supply amount when the oxygen sensor indicates that there is a rich condition. However, and as already been noted, that results in poor performance and/or poor fuel economy. In accordance with this invention, the maximum enrichment amount ⊕ and leaning amount ⊖ are varied in the various control routines and may not be the same numerical values. This is done so as to ensure stable running even under an abnormal condition as may be now understood by reference to FIGS. 4, 5, and 6.

In these figures, the normal maximum enrichment and leaning values are indicated by the vertical dot dash lines while those in accordance with the invention are indicated by the vertical broken lines. The stable running range is shown by the vertical solid lines. It will be seen that by varying these ranges it is possible to maintain good running within the stable range even if an abnormality arises.

Figure 4:
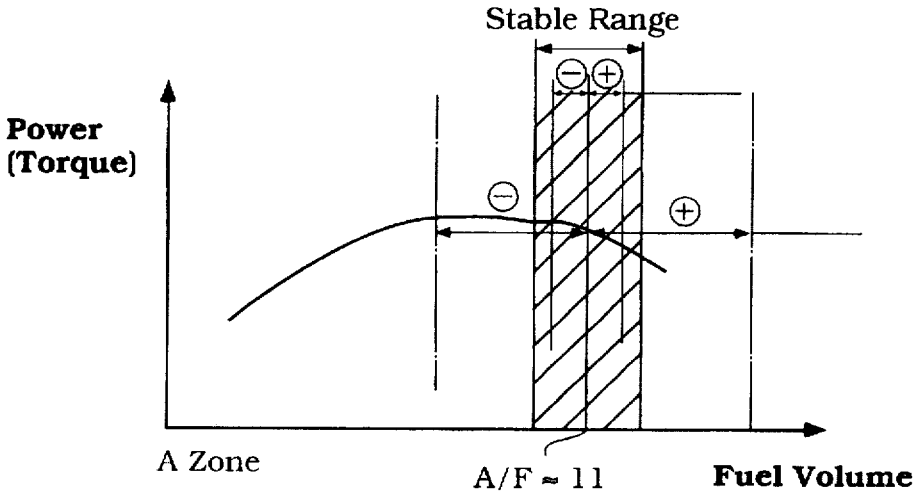
FIG. 4 is a graphical view showing the normal control range and the prior art type of control range in accordance with a prior art type of construction when operating at the zone A indicated in FIG. 3, this being the high speed, high load range.

Referring first to FIG. 4, this shows the high speed, high load range. In this range, there is a relatively small positive enrichment limit which is in the range of about 7% of the total fuel injection amount. This is the maximum amount permitted for enrichment when the sensor 63 indicates that the mixture is lean. There is also a small lean or negative adjustment increase which is slightly smaller than the rich adjustment increase and is in the range of about 5% of the total fuel supply. As a result, the mixture can be somewhat higher on the rich side than the lean side. However, this richness is substantially less than that permitted under the normal fixed incremental plus and minus adjustments permitted by the prior art system which cause the engine to operate well outside of the stable range.

Considering now the lean set region B, again the invention sets the maximum rich and lean adjustments (⊕>⊖) much smaller than the conventional type of system. In this situation, the rich adjustment on the plus side limit is set higher than that on the lean side limit. However, the ranges are in the medium range and that is in the range of about 10–12% of total fuel amount with the high end 12% being permitted for the plus side or enrichment side and the minimum 5% being permitted for the minus or lean side adjust limits. Again, this permits operation within the stable range unlike the prior art type of construction where the lean limit adjustments would permit operation outside of the stable range.

The C zone, that is the zone where there is operation in the idle or troll range, is the one instance where the maximum permitted enrichment and leaning adjustments are approximately equal. These adjustments are in the medium range that is in the range of 10–12% of the total fuel injection amount. Again, this is substantially less than the conventional prior art type of constructions which result in operation outside of the stable range.

FIG. 7 and 8 show respectfully the increase limit map and reduction limit map for varying speed and loads in the remaining general range and also in those control ranges which have been indicated. These maps are contained within the nonvolatile memory of the ECU 57.

Figure 9:
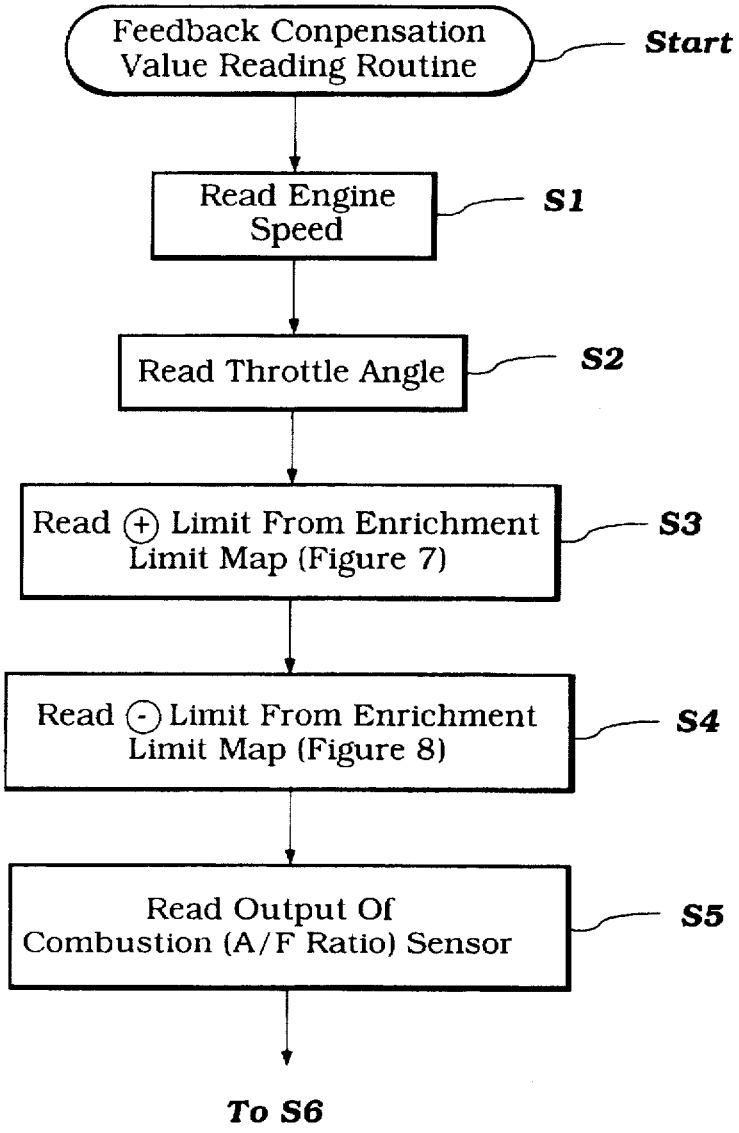
FIG. 9 is a block diagram showing a portion of the feedback control routine.

The actual control routine followed will now be described by reference to FIGS. 9 and 10 and the graph of FIG. 11 will show how the system operates to avoid operation in the unstable ranges and maintain better control in the event of an abnormality. The program begins the feedback compensation value reading routine and most of the step S1 to first read the engine speed. Engine speed is either measured directly or is measured by taking the output of the crank angle sensor 68 in relation to time to determine the instantaneous speed of the crankshaft 15.

The program then moves to the step S2 so as to read the engine load, as determined in this embodiment, by the position of the throttle valve 38 as determined by the throttle position sensor 74.

The program then moves to the step S3 so as to read the ⊕ or enrichment limit from the map of FIG. 7 in the memory for the measured speed and load. Then, at the step S4, the lean limit (⊖) is read from the map of FIG. 8. Again, this is done based on speed and load. Then, at the step S5 the output of the oxygen sensor 63 is read so as to determine if the engine is running either richer or leaner than the desired or target air fuel ratio.

Figure 10:
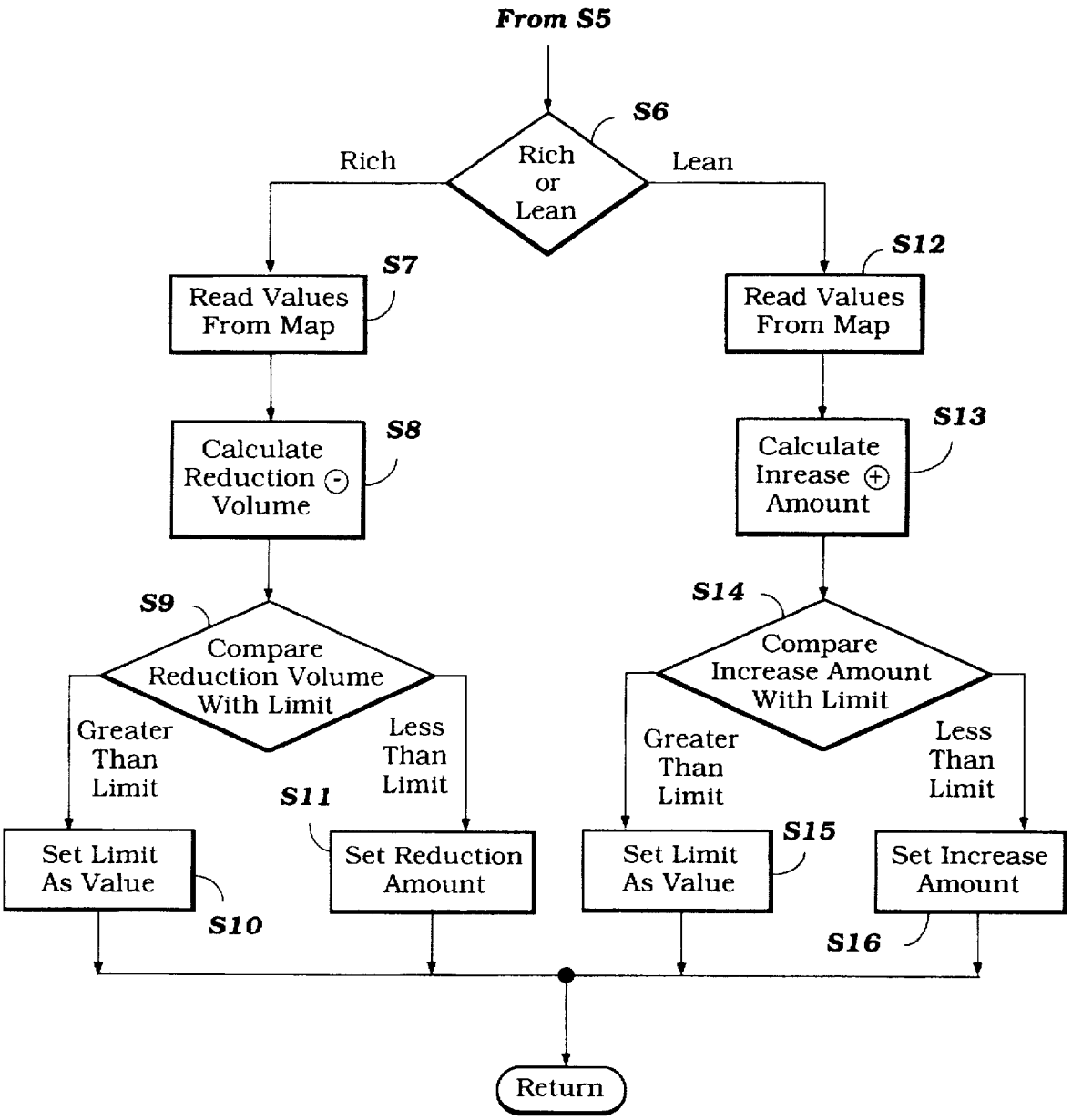
FIG. 10 is a block diagram showing the remainder of the control routine and forms an extension of FIG. 9.

Turning now to the continued flow or back diagram of FIG. 10, the program then moves to the step S6 so as to determine whether the engine is running richer or leaner than the desired air fuel ratio.

Figure 11:
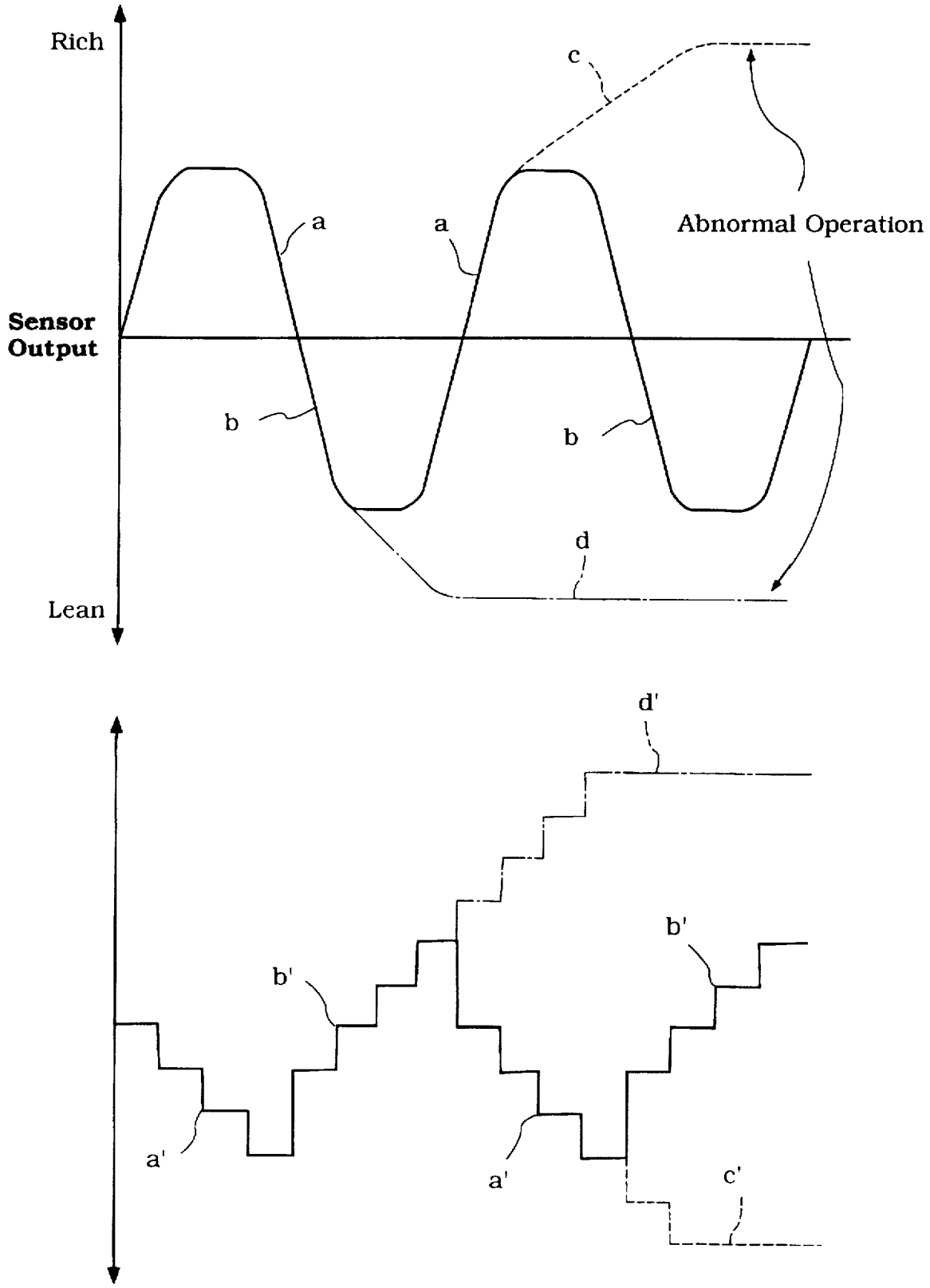
FIG. 11 is a graphical view, in part similar to FIG. 1, and shows the failure mode of operation.

If at the step S6 it is determined that the mixture is on the rich side i.e., operating on the a side of the curve as shown in FIG. 11, then the program moves to the step S7 so as to read the basic fuel injection value amounts from the maps for them at the given conditions. The step then moves to the step S8 so as to calculate the reduction value ⊖ as required from the map indicating correction requirement being necessary. It should be noted that the steps S7 and S8 the calculations are based upon the basic control strategy of the engine that determines the initial injection amount and the correction amounts.

The program then moves to the step S9 so as to compare the calculated reduction value of step S8 with the limit value from the map determined at the step S4. If the reduction value is greater than the limit value, the program moves to the step SI 0 so set the limit value as the value of fuel injection amount correction. The program then returns.

If, however, at the step S9 the reduction volume called for is less than the maximum reduction limit from the map of FIG. 8, then the program sets most of the step S1 so as to set the actual reduction amount called for and the program returns.

If at the step S6 it is determined that the mixture is lean and enrichment is called, the program then moves to the step S12. Again, the values are read from the respective maps so as to calculate the amount of fuel required for the condition. The program then moves to the step S13 so as to calculate the amount of increase and fuel required to bring it to the new value. The program then moves to the step S14 to compare the amount calculated at the step S 13 with the limit set in the map of FIG. 7.

If the amount of increase called for is greater than the limit amount, the program moves to the step S15 so as to set the limit amount as the new value and the program returns. If, however, at the step S14 the increase amount is less than the limit amount, then the program moves to the step S16 so as to set the new increase amount and then returns.

Figure 1:
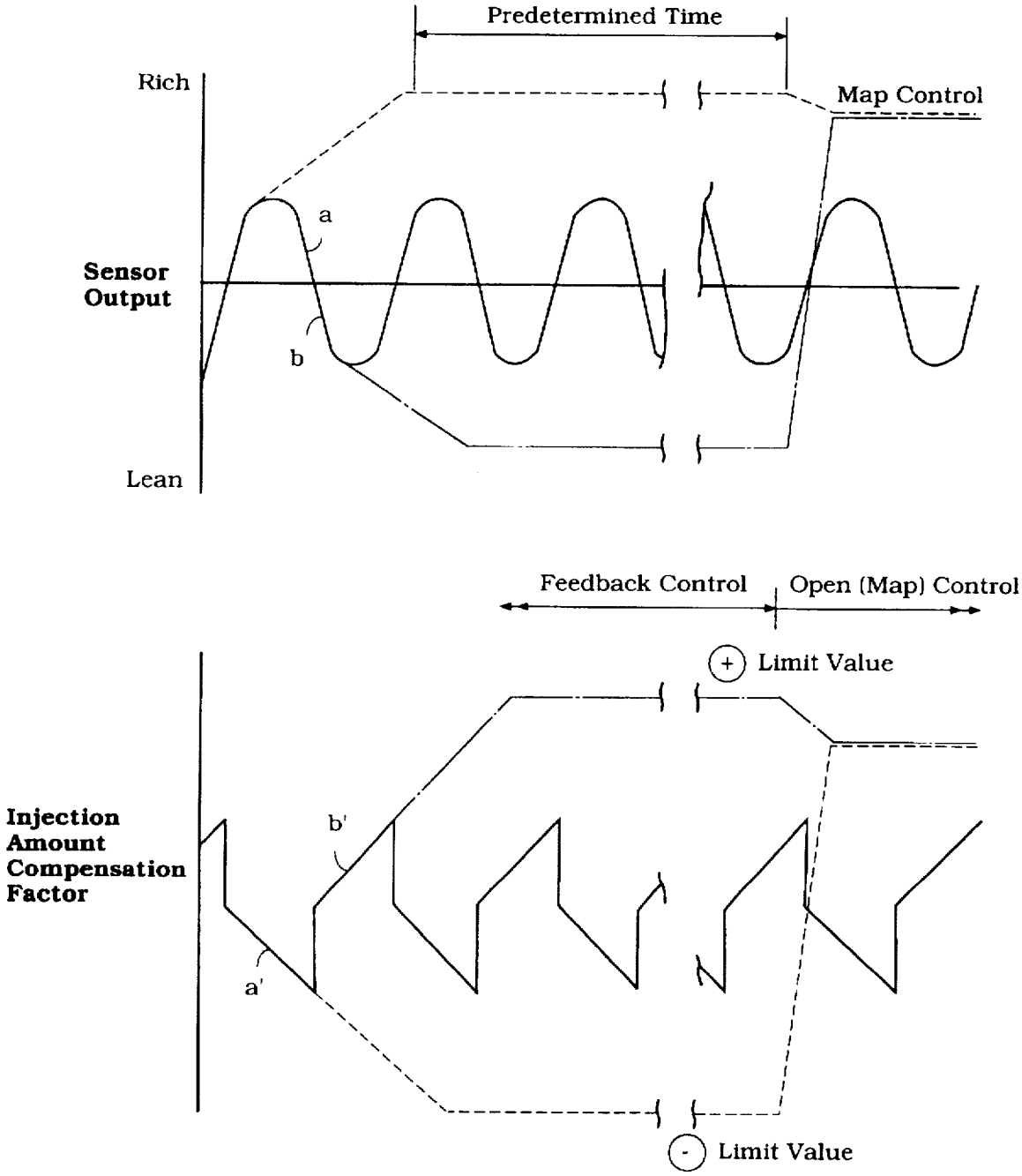
Figure 1 Prior Art
FIG. 1 is a graphical view showing the sensor output and fuel injection compensation amount during cycles of operation with a conventional prior art type of control system.

The effect of this and the reduced limits can be seen from FIG. 11 which is a figure similar to FIG. 1 but shows the actual stepping increases for changing the injection amounts.

Thus, when the control routine begins and the fuel air ratio sensor are oxygen sensor 63 outputs a signal indicating richness, the routine phase a, the program then successively reduces the amount of fuel injected in increments as shown by the steps a'. This continues until the mixture goes lean and enters the sensor output phase b. The mixture is then enriched along with the steps as indicated at the lower curve of b'.

If, however, the mixture goes to rich because of some failure or abnormality in the system, the system will continue the increases as shown at d'. In accordance with the invention, however, once the reduction limit is met, then the further increases stop and over richness is avoided.

Figure 12:
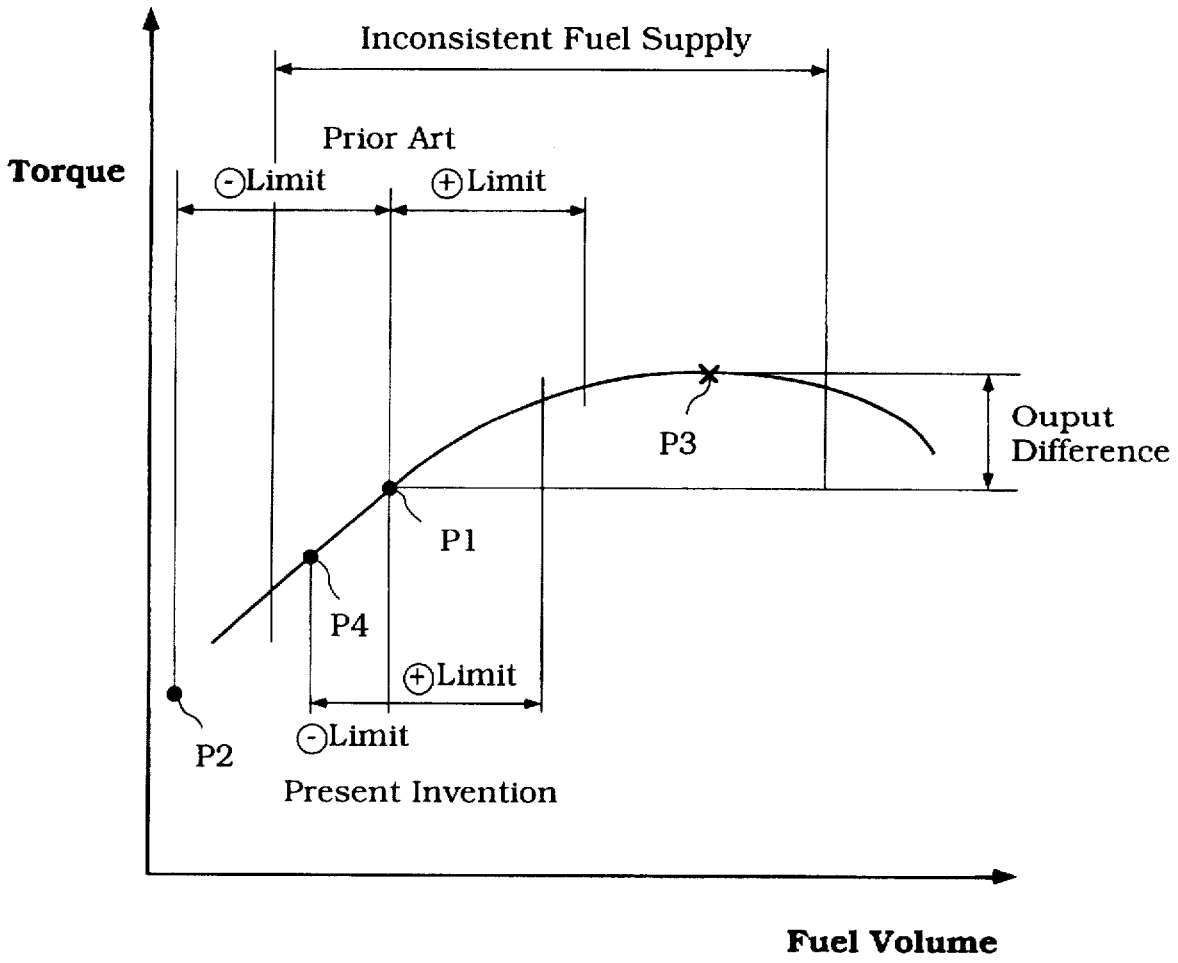
FIG. 12 is a graphical view showing the fuel injection amount versus engine performance in comparison with the invention and the prior art during steady state control.

FIG. 12 shows a torque curve and fuel volume supply arrangement to show how the amount of fuel supplied varies the torque curve. However, when operating near maximum torque and in the range indicated as "inconsistent fuel supply" the actual fuel supplied to the invention may vary in an open control system. Thus, it is desirable to try to operate the engine in a range between the points indicated at between P1 and P3 in this figure. This is to avoid overheating of the engine by maintaining an appropriate air fuel ratio.

With the prior art type of construction using fixed enrichment and leaning limits, however, the engine can operate in the range P1 where the mixture is too lean and damage can occur. In addition, the performance will fall off significantly. By setting the smaller limits in accordance with this invention as shown, the engine will always operate in a range between the point P4 which is well within the range where overheating will occur and a point before the torque curve peak P3 so as to ensure good power output. Again, this system operates to provide an improvement over the prior art type construction.

Figure 13:
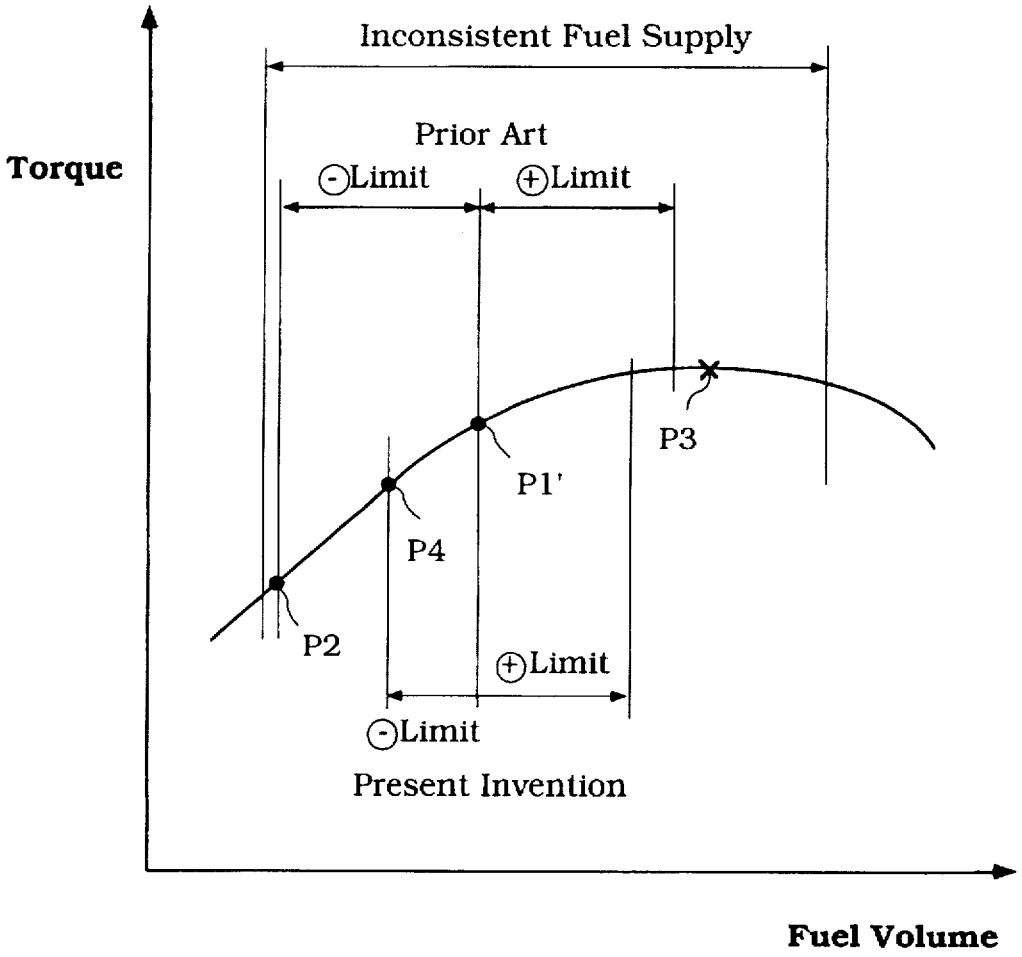
FIG. 13 is a graphical view, in part similar to FIG. 12 and shows the condition during the transitional phase of engine operation.

FIG. 13 also shows the same characteristics when running during a transitional phase. That is, this a curve consistent to the acceleration or deceleration curves. Again, it would be seen that the limits are substantially less than those of the prior art type of construction and hence the engine control will be maintained much better than with prior art type of constructions.

Thus, from the foregoing description it should be readily apparent that the described invention is extremely useful in providing good engine control even when an abnormal condition may be encountered and feedback control may no longer be effective. Also, the system permits return to normal control under feedback control system to be smoother and less erratic.

Of course, the foregoing description is that of preferred embodiments of the invention, and various changes and modifications may be made without departing from the spirit and scope of the invention, as defined by the appended claims.

What is claimed is:

1. A control method for an internal combustion engine having a combustion chamber, a fuel air charging system for delivering fuel and air to said combustion chamber, and an exhaust system for discharging a burnt charge from said combustion chamber, said method comprising the steps of setting a desired air fuel ratio, sensing engine running characteristics, sensing the air fuel ratio of the combustion products within said combustion chamber, providing a feedback control for altering the fuel air ratio to maintain the set air fuel ratio in a desired range, and setting a variable limit of maximum and minimum fuel supply during feedback control for a set air fuel ratio in response to a specific sensed engine running characteristics so as to variably limit the degree of maximum correction that can be made when an abnormal situation occurs.

2. The engine feedback control method as set forth in claim 1, wherein the maximum enrichment amount permitted is different from the maximum reduction amount under at least some engine running conditions.

3. The engine feedback control method as set forth in claim 2, wherein the enrichment limit is less than the reduction limit under the certain running condition.

4. The engine feedback control method as set forth in claim 1, wherein the limits are set at different values for different engine running conditions.

5. The engine feedback control method as set forth in claim 4, wherein the limits under high speed, high load conditions are less than those under low speed, low load conditions.

6. The engine feedback control method as set forth in claim 4, wherein the limits are set lower in the low speed, low load range than in other operational ranges.

7. The engine feedback control method as set forth in claim 6, wherein the limits under high speed, high load condition are less than those under low speed, low load condition.

8. The engine feedback control method as set forth in claim 4, wherein the limits during high speed, high load; low speed, low load; and transitional running are set different from those under all other running conditions.

9. An internal combustion engine having a combustion chamber, a fuel air charging system for delivering fuel and air to said combustion chamber, and an exhaust system for discharging a burnt charge from said combustion chamber, means for sensing engine running characteristics, control means for setting a desired air fuel ratio, means for sensing the air fuel ratio of the combustion products within said combustion chamber, a feedback control for altering the fuel air ratio to maintain the set air fuel ratio in a desired range, and means for setting variable limits of maximum and minimum fuel supply for the set air fuel ratio during feedback control in response to a specific sensed engine running characteristics so as to limit the degree of maximum correction that can be made when an abnormal situation occurs.

10. The engine as set forth in claim 9, wherein the maximum enrichment amount permitted is different from the maximum reduction amount under at least some engine running conditions.

11. The engine as set forth in claim 10, wherein the enrichment limit is less than the reduction limit under the certain running condition.

12. The engine as set forth in claim 9, wherein the limits are set at different values for different engine running conditions.

13. The engine as set forth in claim 12, wherein the limits under high speed, high load conditions are less than those under low speed, low load conditions.

14. The engine as set forth in claim 12, wherein the limits are set lower in the low speed, low load range than in other operational ranges.

15. The engine as set forth in claim 14, wherein the limits under high speed, high load condition are less than those under low speed, low load condition.

16. The engine as set forth in claim 14, wherein the limits during high speed, high load; low speed, low load; and transitional running are set different from those under all other running conditions.

* * * * *